US007020412B2

(12) United States Patent
Yoshida

(10) Patent No.: US 7,020,412 B2
(45) Date of Patent: Mar. 28, 2006

(54) IMAGE FORMING APPARATUS THAT PREVENTS GENERATION OF IMAGE NOISE BY CONTROLLING CREEP OF A FLEXIBLE MOVABLE MEMBER

(75) Inventor: Narutaka Yoshida, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 123 days.

(21) Appl. No.: 10/773,262

(22) Filed: Feb. 9, 2004

(65) Prior Publication Data

US 2005/0084281 A1 Apr. 21, 2005

(30) Foreign Application Priority Data

Oct. 20, 2003 (JP) ..... 2003-359000

(51) Int. Cl.
*G03G 21/20* (2006.01)

(52) U.S. Cl. ..... 399/94; 399/96; 399/162; 399/302; 399/308

(58) Field of Classification Search ..... 399/91, 399/94, 95, 96, 97, 162, 165, 175, 302, 303, 399/308, 329
See application file for complete search history.

(56) References Cited

U.S. PATENT DOCUMENTS 5,991,561 A * 11/1999 Okamoto et al. ..... 399/66
6,198,889 B1 * 3/2001 Yu et al. ..... 399/75
6,201,943 B1 * 3/2001 Asakura et al. ..... 399/297

FOREIGN PATENT DOCUMENTS

JP 5-45959 2/1993
JP 2000-136855 5/2000
JP 2001-175139 6/2001

* cited by examiner

*Primary Examiner*—Hoan Tran
(74) *Attorney, Agent, or Firm*—Morrison & Foerster LLP

(57) ABSTRACT

In order to prevent generation of image noise by controlling creep of a movable member having flexibility an image forming apparatus for forming images in a recording medium includes a movable member having flexibility, a detection section for detecting temperature of the movable member directly, and a control section for executing control so that when image forming is not conducted, the movable member is temporarily operated at predefined intervals if a temperature detected by the detection section is equal to or above a specified temperature, and the movable member is not operated if a temperature detected by the detection section is below the specified temperature.

20 Claims, 6 Drawing Sheets

IMAGE FORMING APPARATUS THAT PREVENTS GENERATION OF IMAGE NOISE BY CONTROLLING CREEP OF A FLEXIBLE MOVABLE MEMBER

RELATED APPLICATION

This application is based on Japanese Patent Application No. 2003-359000, the content of which is incorporated herein by reference.

BACKGROUND OF THE INVENTION

The present invention relates to an image forming apparatus capable of preventing generation of image noise by controlling creep of movable members having flexibility such as intermediate transfer belts for use in copying machines and printing machines.

In image forming apparatuses such as copying machines and printing machines, movable members having flexibility such as intermediate transfer belts have conventionally been used. Such movable members possibly suffer creep that is the increase of a strain with a lapse of time under the action of constant external force. The creep has dependence on curvature deformation degree, temperature, curvature deformation state retention time, and material properties of the movable members. Accordingly, in order to prevent the creep of the movable members, improvement of their materials are generally conducted, and if that measure alone is not sufficient, made are such attempts as decreasing the deformation degree of the movable members and/or controlling temperature rise thereof.

However, the trend of image forming apparatuses in recent years is toward downsizing, and so a space inside the apparatus becomes small. Consequently, the movable members set in the apparatus are often disposed in the state of having a high deformation degree, which is counted as a disadvantage with respect to creep. For example, a roller which supports an intermediate transfer belt that is a movable member having flexibility from therewithin is, for example, 30 mm in diameter in the case of a conventional model, whereas the roller is, for example, 24 mm in diameter in the case of a recent model. Thus, decreasing the diameter of the roller achieves space saving, which, however, causes the intermediate transfer belt to be supported in the state of being curvature-deformed with a curvature larger than a conventional one. With such a large curvature, creep tends to be generated in a portion of the intermediate transfer belt supported in the state of being curvature-deformed under the action of predefined tension, and when creep deformation is increased, image noise is generated in that portion.

Generally, the creep is highly dependent on temperature, so that the inside of the apparatus and the intermediate transfer belt are cooled by means of a fan in order to cope with the creep while maintaining space-saving achievement. However, the use of the fan itself is discontinued in most cases in light of cost saving in these days, which works against solving the problem of the creep generated in the movable members having flexibility in terms of temperature.

SUMMARY OF THE INVENTION

Accordingly, an object of the present invention is to provide, amid a trend of down sizing and cost saving, an image forming apparatus which prevents generation of image noise by controlling creep in movable members having flexibility, as well as a control method thereof.

In order to accomplish the aforementioned object, one aspect of the present invention is an image forming apparatus for forming images on a recording medium, comprising:

a movable member having flexibility;

a detection section for detecting temperature of the movable member directly or indirectly; and a control section for executing control so that when image forming is not conducted, the movable member is temporarily operated at predefined intervals if a temperature detected by the detection section is equal to or above a specified temperature, and the movable member is not operated if a temperature detected by the detection section is below the specified temperature.

In the above-structured image forming apparatus of the present invention, control is executed so that when image forming is not conducted, the movable member having flexibility is temporarily operated at predefined intervals based on a temperature detected by the detection section. This makes it possible to prevent a certain portion in the movable member from being retained for a long period of time under the action of external force and in the state of being curved at high temperature, thereby achieving control of creep generated in the movable member. As a result, it becomes possible to prevent generation of image noise caused by creep deformation of the movable member.

In the image forming apparatus of the present invention, the predefined intervals may be changed depending on the temperature detected by the detection section.

Further in the image forming apparatus of the present invention, the operating time of the movable member that is temporarily operated may be changed depending on the temperature detected by the detection section.

Further in the image forming apparatus of the present invention, the detection section may detect the temperature of the movable member indirectly from an inside temperature of the apparatus.

Further in the image forming apparatus of the present invention, the detection section may detect the temperature of the movable member indirectly from an image printing mode.

Still further in the image forming apparatus of the present invention, the control section may temporarily operate the movable member immediately after the temperature detected by the detection section becomes equal to or above a specified temperature, or may temporarily operate the movable member once the temperature detected by the detection section becomes and stays equal to or above a specified temperature for not less than predefined consecutive time, or may temporarily operate the movable member once a duration of time during which the temperature detected by the detection section becomes and stays equal to or above a specified temperature amounts to not less than predefined time.

Further in the image forming apparatus of the present invention, the movable member may be an endless belt hung over at least two rollers. In this case, the endless belt may be an intermediate transfer belt or a fixing belt.

Further in the image forming apparatus of the present invention, the movable member may be an electrically-charging member.

In order to accomplish the above object, another aspect of the present invention is a method for controlling an image forming apparatus including a movable member having flexibility, comprising:

a step 1 for detecting a temperature of the movable member directly or indirectly when the image forming apparatus is not under image forming operation; and a step 2 for executing control so that the movable member is temporarily operated at predefined intervals if the temperature detected in the step 1 is equal to or above a specified temperature, and the movable member is not operated if the detected temperature is below the specified temperature.

In the control method of the present invention, the predefined intervals in the step 2 may be changed depending on the temperature detected in the step 1.

Further in the control method of the present invention, operating time of the movable member that is temporarily operated in the step 2 may be changed depending on the temperature detected in the step 1.

Further in the control method of the present invention, the movable member may be temporarily operated in the step 2 immediately after the temperature detected in the step 1 becomes equal to or above a specified temperature.

Further in the control method of the present invention, the movable member may be temporarily operated in the step 2 once the temperature detected in the step 1 becomes and stays equal to or above the specified temperature for not less than predefined consecutive time.

Further in the control method of the present invention, the movable member may be temporarily operated in the step 2, once a duration of time during which the temperature detected in the step 1 becomes and stays equal to or above a specified temperature amounts to not less than specified time.

Further in the control method of the present invention, the movable member may be an endless belt hung over at least two rollers. In this case, the endless belt may be an intermediate transfer belt.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
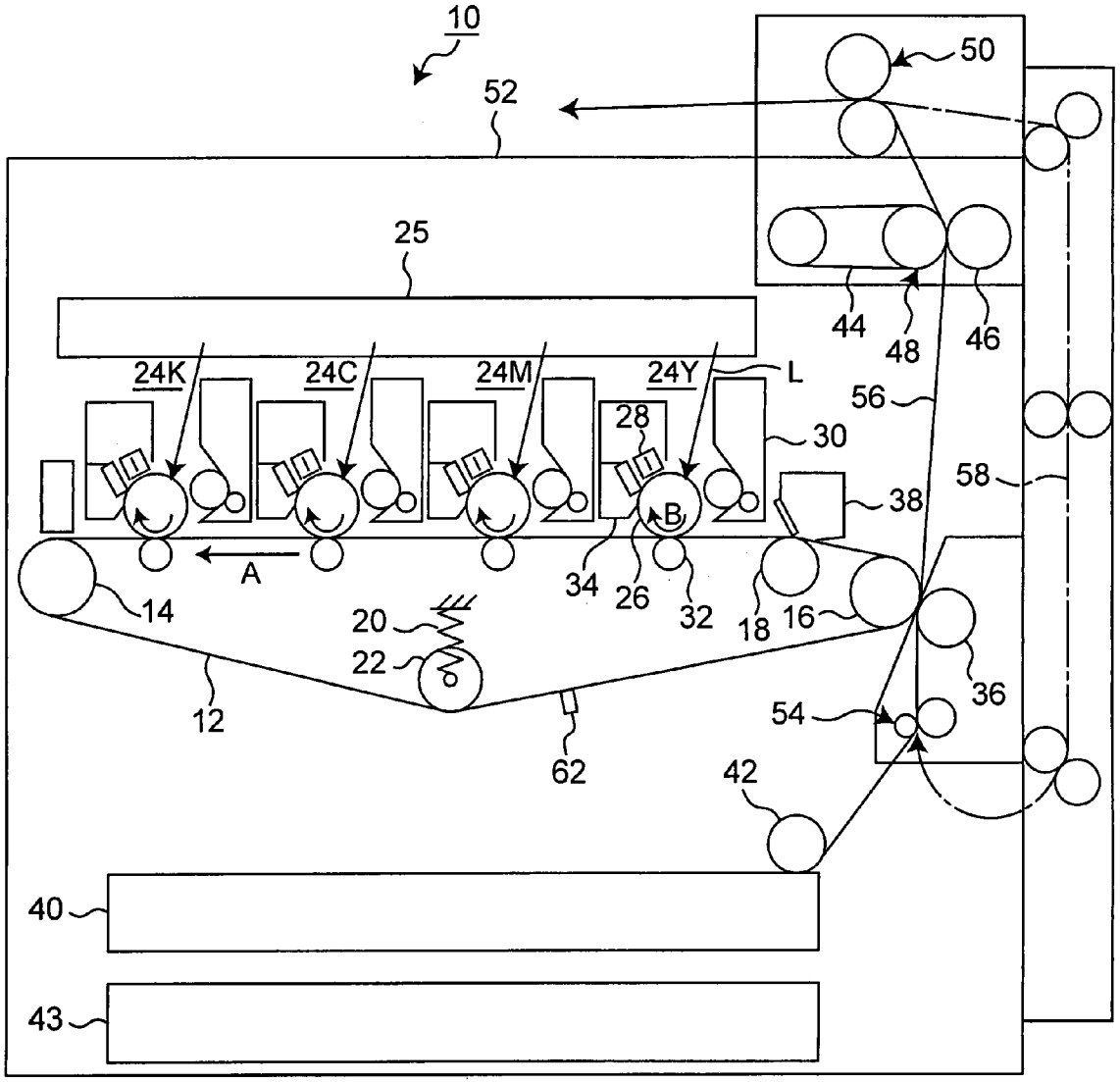
FIG. 1 is an overall schematic diagram showing an image forming apparatus.

FIG. 1 shows an overall configuration of an image forming apparatus 10 in one embodiment of the present invention. The image forming apparatus 10 is equipped with an intermediate transfer belt 12 that is a movable member having flexibility situated in an almost center section of the apparatus. The intermediate transfer belt 12 is composed of an endless belt made of a thin resin film.

The intermediate transfer belt 12 is hung over three support rollers 14, 16, 18 that are provided inside of the intermediate transfer belt 12. A tension roller 20 pressed by a spring 20 is in press-contact with the intermediate transfer belt 12 from inside, so that the intermediate transfer belt 12 is under the action of a specified tension (external force). Thus, the intermediate transfer belt 12 is in an inoperative state with the roller-supported portions being curved under the action of the specified tension when image forming is not under operation. Further, the support roller 14 is a driving roller that is interlocked with an unshown motor and driven so as to rotate, and when the support roller 14 is driven so as to rotate, the intermediate transfer belt 12 is rotated in an arrow A direction. Furthermore, an intermediate transfer belt temperature sensor (detection section) 62 is disposed in contact with or in the vicinity of the intermediate transfer belt 12 for directly detecting the temperature thereof. It is to be noted that the number of the support rollers for the intermediate transfer belt 12 may be at least not less than two.

On the intermediate transfer belt 12, there are disposed four print units 24Y, 24M, 24C, 24K in order alongside each other. These four print units 24Y, 24M, 24C, 24K respectively correspond to a yellow toner, a magenta toner, a cyan toner, and a black toner. With respect to the moving direction of the intermediate transfer belt 12, the print unit 24Y for yellow toner is located on the most upstream side, and the print unit 24K for black toner is located on the most downstream side. Above each of the print units 24Y, 24M, 24C, 24K, a laser unit 25 is disposed.

Each of the print units 24Y, 24M, 24C, 24K has an identical configuration and includes a drum-shaped photo conductor 26 with a thin film made of an Organic Photo Conductor (OPC) material being formed on the surface thereof. The photo conductor 26 is driven so as to rotate in an arrow B direction by an unshown motor. Each of the print units 24Y, 24M, 24C, 24K is disposed so that each of their photo conductors 26 is in contact with the intermediate transfer belt 12.

Around the photo conductor 26, there are disposed, in an order along the rotating direction of the photo conductor 26, an electrical charger 28 for equally electrifying the surface of the photo conductor 26, a developing unit 30 for developing with a toner an electrostatic latent image composed of a potential-attenuated portion formed on the surface of the equally electrified photo conductor 26 by exposing it to light from the laser unit 25 to produce a toner image, a primary transfer roller 32 disposed with the intermediate transfer belt 12 being interposed between the primary transfer roller 32 and the photo conductor 26 for primarily transferring the toner image formed on the photo conductor 26 onto the intermediate transfer belt 12, and a cleaner 34 for scraping and collecting a residual toner on the surface of the photo conductor 26 after primary transfer is conducted. It is to be noted that the electrically-charged member for equally electrifying the surface of the photo conductor 26 may be a flexible electrically-charged brush or a flexible electrically-charged roller, which is in press-contact with the surface of the photo conductor 26 and allows rotative drive.

Further, a secondary transfer roller 36 is disposed so as to be in contact with a portion of the intermediate transfer belt 12 supported by the support roller 16. The secondary transfer roller 36 is for conducting secondary transfer of a toner image, that was primarily transferred onto the intermediate transfer belt 12, onto a recording medium such as paper.

Further, on the downstream side of the secondary transfer roller 36 with respect to the moving direction of the intermediate transfer belt 12, a cleaner 38 is disposed. The cleaner 38 is for scraping and collecting residual toners on intermediate transfer belt 12 after secondary transfer is conducted.

On a lower portion in the image forming apparatus 10, a paper feed cassette 40 is disposed. Recording media such as paper stacked and housed in the paper feed cassette 40 are sent out sheet by sheet by a paper feed roller 42. Below the paper feed cassette 40, disposed is a power supply 43 for supplying power to each section of the image forming apparatus 10.

On an upper portion in the image forming apparatus 10, there are disposed a fixing device 48 composed of an endless fixing belt 44 hung over two rollers and a pressure roller 46 to form a fixing nip between the fixing belt 44 and the pressure roller 46, and a discharge roller 50 composed of a pair of rollers. Moreover, the upper surface of the image forming apparatus 10 forms a discharged paper tray 52.

Paper sent out from the paper feed cassette 40 travels, from the paper feed cassette 40, through a nip section between a pair of conveyer rollers 54, a nip section between the intermediate transfer belt 12 and the secondary transfer roller 36, the fixing nip of the fixing apparatus 48, and a nip section of the discharge roller 50, and is conveyed along a conveyer route 56 extending in an approximately vertical direction.

On a lateral side of the image forming apparatus 10, a circulation route 58 shown with a chain line is provided. A one-side printed sheet of paper switched back by the discharge roller 50 is then conveyed downward through the circulation route 58 to a pair of the conveyer rollers 54, and is again conveyed upward through the conveyer route 56 with its unprinted side facing the side of the intermediate transfer belt 12.

Figure 2:
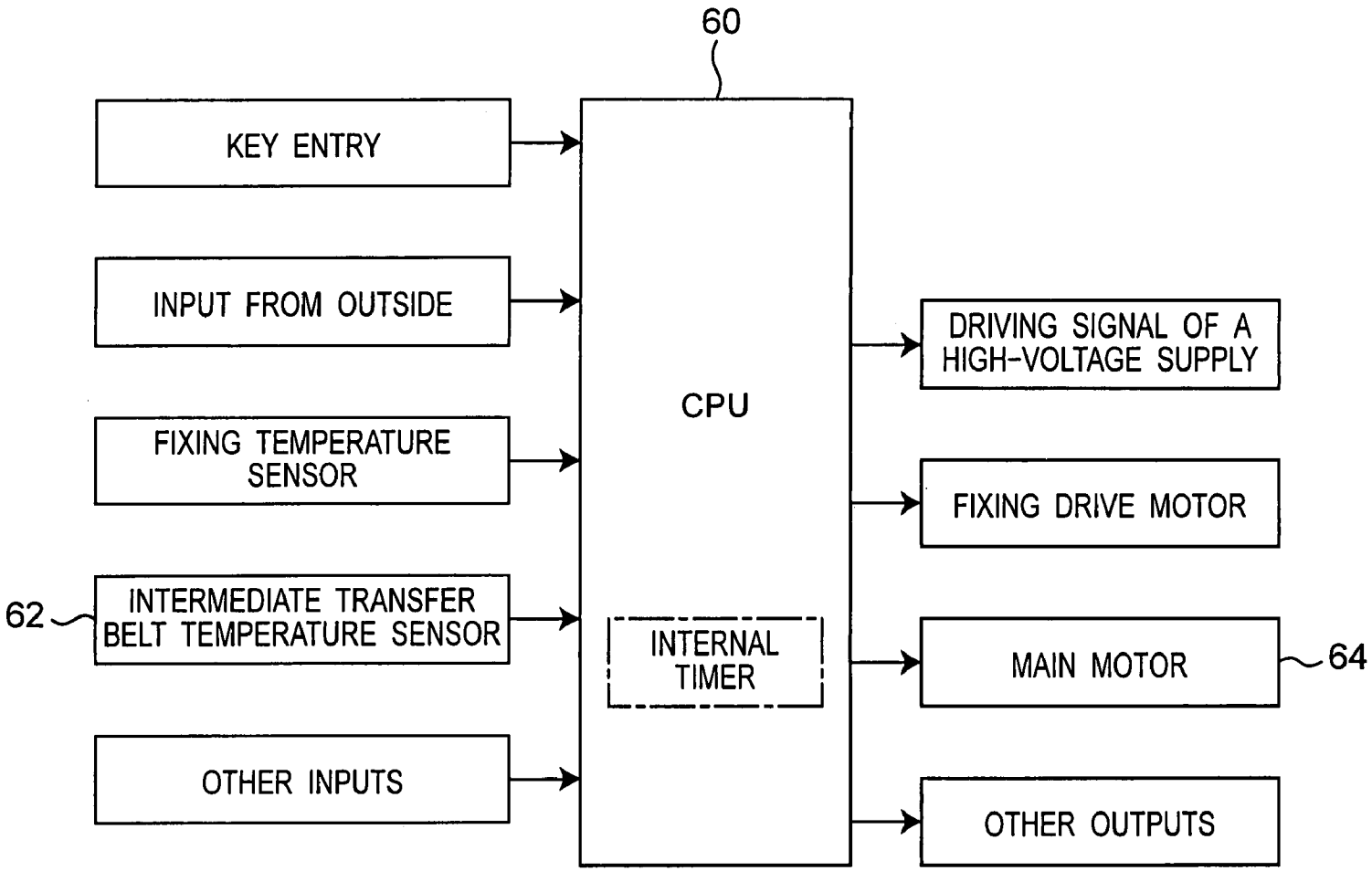
FIG. 2 is a block diagram showing a control section.

As shown in FIG. 2, the image forming apparatus 10 includes a control section 60 composed mainly of a CPU. The control section 60 has an internal timer. The control section 60 receives a key entry from an unshown operation panel, an input from outside of the apparatus, an input of detected temperature from a fixing temperature sensor, an input of detected temperature from the intermediate transfer belt temperature sensor 62 that directly detects a temperature of the intermediate transfer belt 12, as well as other inputs. The control section 60 also outputs a driving signal of a high-voltage supply 42, a driving signal of a fixing drive motor for driving the fixing device 48, a driving signal of a main motor 64 for driving the intermediate transfer belt 12 and each of the print units 24Y, 24M, 24C, 24K, as well as other output signals. Moreover, the control section 60 executes control, as described later, so that the intermediate transfer belt 12 is temporarily operated at predefined intervals based on a temperature detected by the intermediate transfer belt temperature sensor 62 when image forming is not operated.

Description will be now given of the operation and control of the above-configured image forming apparatus 10.

Upon reception of a printing signal inputted from outside, the control section 60 starts image forming operation by activating the intermediate transfer belt 12 and the print units 24Y, 24M, 24C, 24K.

In the case of a full color image, four print units 24Y, 24M, 24C, 24K are each driven. In each of the print units 24Y, 24M, 24C, 24K, the surface of the photo conductor 26 that is driven so as to rotate in an arrow B direction is equally electrified by the electrical charger 28. Then, the equally electrified surface of the photo conductor 26 is exposed to a laser beam L radiated from the laser unit 25, by which a potential of the exposed portion is attenuated, and therefore an electrostatic latent image is formed.

Then, the electrostatic latent image formed on the surface of each photo conductor 26 is developed with a toner by the developing unit 30 into a toner image. The toner image formed on the surface of the photo conductor 26 is primarily transferred onto the intermediate transfer belt 12 by the electric action of the primary transfer roller 32. Four toner images formed respectively in the print units 24Y, 24M, 24C, 24K are primarily transferred on the intermediate transfer belt 12 in the state of being superimposed on one another. A residual toner on the surface of each photo conductor 26 after the primary transfer is collected by the cleaner 34.

In the case of a monochrome image, only the print unit 24K is activated and therefore only a black toner image is transferred onto the intermediate transfer belt 12.

The toner image transferred on the intermediate transfer belt 12 is moved toward a section facing the secondary transfer roller 36 as the intermediate transfer belt 12 is rotated. There, under the electric action of the secondary transfer roller 36, the toner image is secondarily transferred onto a sheet of paper conveyed from the paper feed cassette 40. Residual toners on the intermediate transfer belt 12 after the secondary transfer are collected by the cleaner 38.

The sheet of paper onto which the toner image was transferred is continued to be conveyed upward through the conveyer route 56, and when the paper passes the fixing nip of the fixing device 48, the toner image is fixed on the paper. After that, the paper is discharged to the discharged paper tray 52 through the discharge roller 50.

In the case of two-side printing, a one-side printed sheet of paper is switched back by the discharge roller 50, sent to the circulation route 58, conveyed again to the conveyer route 56 after traveling the circulation route 58, and after a toner image is transferred onto and fixed on an unprinted side of the paper, the paper is discharged to the discharged paper tray 52 from the discharge roller 50.

In the image forming operations as described above, each component part needs to maintain its predefined shape for proper functioning of respective processes. In the case of the intermediate transfer belt 12 for example, the intermediate transfer belt 12 is, for example, a thin-film endless belt made of resin that consists of a compound of polycarbonate and polybutylene terephthalate. As shown in FIG. 1, the intermediate transfer belt 12 is supported by three support rollers 14, 16, 18, and a tension is applied to the intermediate transfer belt 12 by a tension roller 22 so that the intermediate transfer belt 12 is in close contact with each of the support rollers 14, 16, 18. The intermediate transfer belt 12, which performs rotative operation for image forming operation while the tension is applied thereto, is retained in an inoperative state during standby when image forming is not operated.

Though no problem is seen under general environment, the inside temperature of the apparatus becomes high when an ambient temperature outside the apparatus rises. Furthermore, in the case of two-side printing, the intermediate transfer belt 12 is retained at high temperature due to the influence of heat conducted to a sheet of paper when the paper passes the fixing device 48. If the intermediate transfer belt 12 is left at high temperature for a long period of time when image forming is not operated, a creep deformation is generated on the intermediate transfer belt 12, and more particularly, the creep deformation tends to be generated in the portions of the intermediate transfer belt 12 supported by the support rollers 14, 16, 18 in the state of being curved in the action of an external force, i.e., a tension. Conventionally, the support rollers 14, 16, 18 have been, for example, 30 mm in diameter and therefore stress exerted to the intermediate transfer belt 12 has been relatively small. However, with recent models, smaller support rollers 14, 16, 18 whose diameter are, for example, 24 mm are used, so that a curvature of the portions of the intermediate transfer belt 12 supported by these support rollers 14, 16, 18 is larger than before, which is counted as an disadvantage with respect to the creep deformation.

When a creep deformation is generated in the portions of the intermediate transfer belt supported by the support rollers 14, 16, 18, the contact of the portions with the photo conductors 26 is deteriorated, hindering appropriate transfer of toner images on the photo conductors 26 onto the intermediate transfer belt 12. More particularly, in a portion of the intermediate transfer belt with a creep deformation in an arched shape, space is generated between the portion and the photo conductor 26, which disables a part of the toner image on the photo conductor 26 from being transferred onto the intermediate transfer belt, thereby causing image noise that looks like partial dropouts. If the creep deformation is small, the intermediate transfer belt 12 can still comes into contact with the surface of the photo conductor 26. However, if the creep deformation is large, the image noise as described above is generated. Therefore, the creep deformation of the intermediate transfer belt 12 should be restrained as much as possible for prevention of the image noise.

Figure 3:
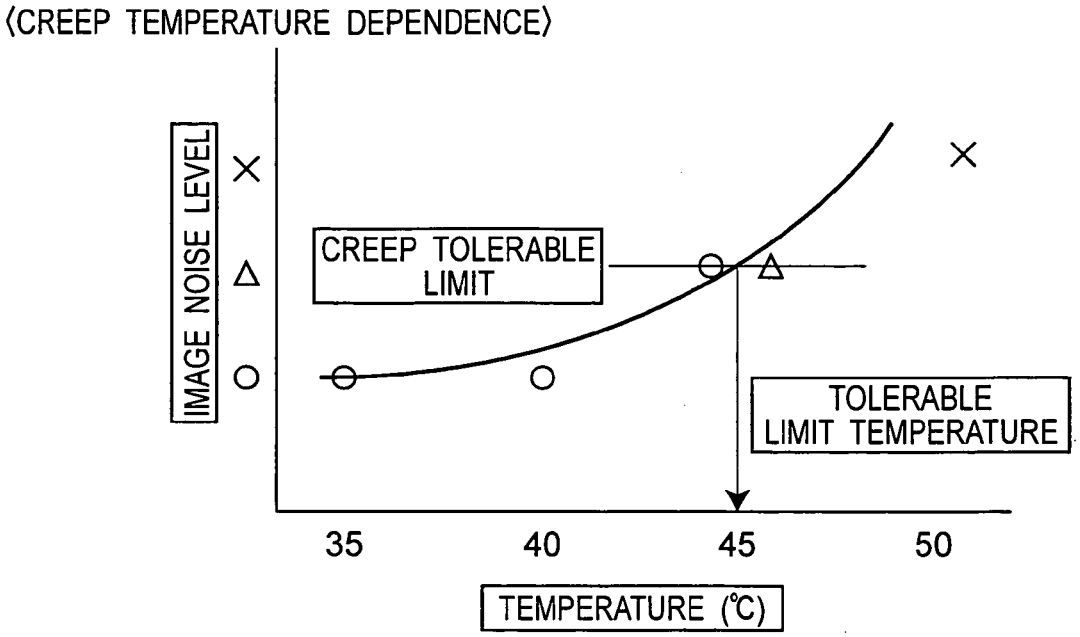
FIG. 3 is a graph view showing the relation between temperature and image noise level.

A graph in FIG. 3 shows the relation between temperature and an image noise level due to a creep deformation of the intermediate transfer belt 12 when the image forming apparatus 10 of the present embodiment is left for 72 hours under a specified temperature condition. In this experiment, since degradation of concentration is seen in a part of an image which is corresponding to a portion of the intermediate transfer belt 12 with a creep deformation, the degradation level of concentration was rated into 3 categories: ○ (tolerable), Δ (tolerable limit),and x (intolerable) by visual inspection. As shown in FIG. 3, at the temperature of 45° C. or above, the creep deformation of the intermediate transfer belt 12 exceeded the tolerable limit and the image noise reached the intolerable level.

Figure 4:
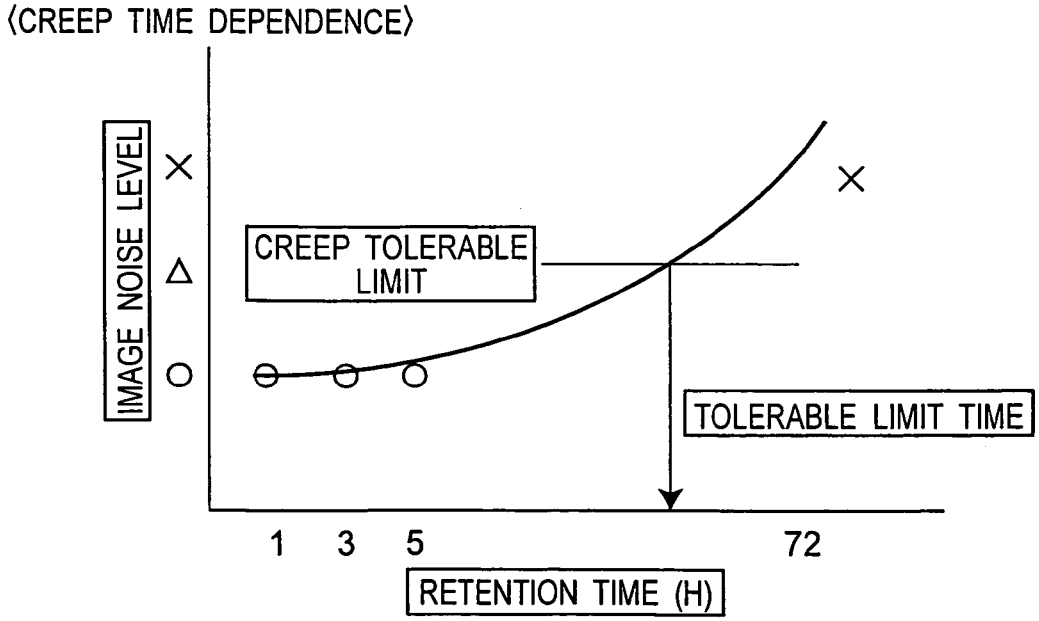
FIG. 4 is a graph view showing the relation between retention time and image noise level.

Further, a graph in FIG. 4 shows the relation between a duration of time during which the image forming apparatus 10 of the present embodiment is left under the temperature condition of 50° C. and image noise due to the creep deformation of the intermediate transfer belt 12. Determination in this experiment was made in the same way as the experiment of FIG. 3. As shown in FIG. 4, the noise level stayed in a tolerable level if the image forming apparatus 10 is left in a high-temperature state over 45° C. only for a short period of time.

These experiments clarified that it is possible to keep the creep deformation of the intermediate transfer belt 12 within the tolerable levels if the temperature of the intermediate transfer belt 12 is controlled so as not to exceed a specified temperature, or if the retention time in an inoperative state is controlled to be within a predefined duration of time even at a temperature over the specified temperature. More specifically, it is possible to restrain the creep deformation of the intermediate transfer belt 12 if the temperature of the intermediate transfer belt 12 is kept 45° C. or lower, or if portions of the intermediate transfer belt 12 supported by the support rollers 14, 16, 18 are changed at predefined intervals if the temperature is 45° C. or more. Accordingly, in the image forming apparatus 10 of the present embodiment, the intermediate transfer belt 12 is controlled to be temporarily operated so as to rotate at predefined intervals if the temperature of the intermediate transfer belt 12 is a specified temperature or more as described below, by which the creep deformation of the intermediate transfer belt 12 is restrained and image noise is prevented.

Figure 5:
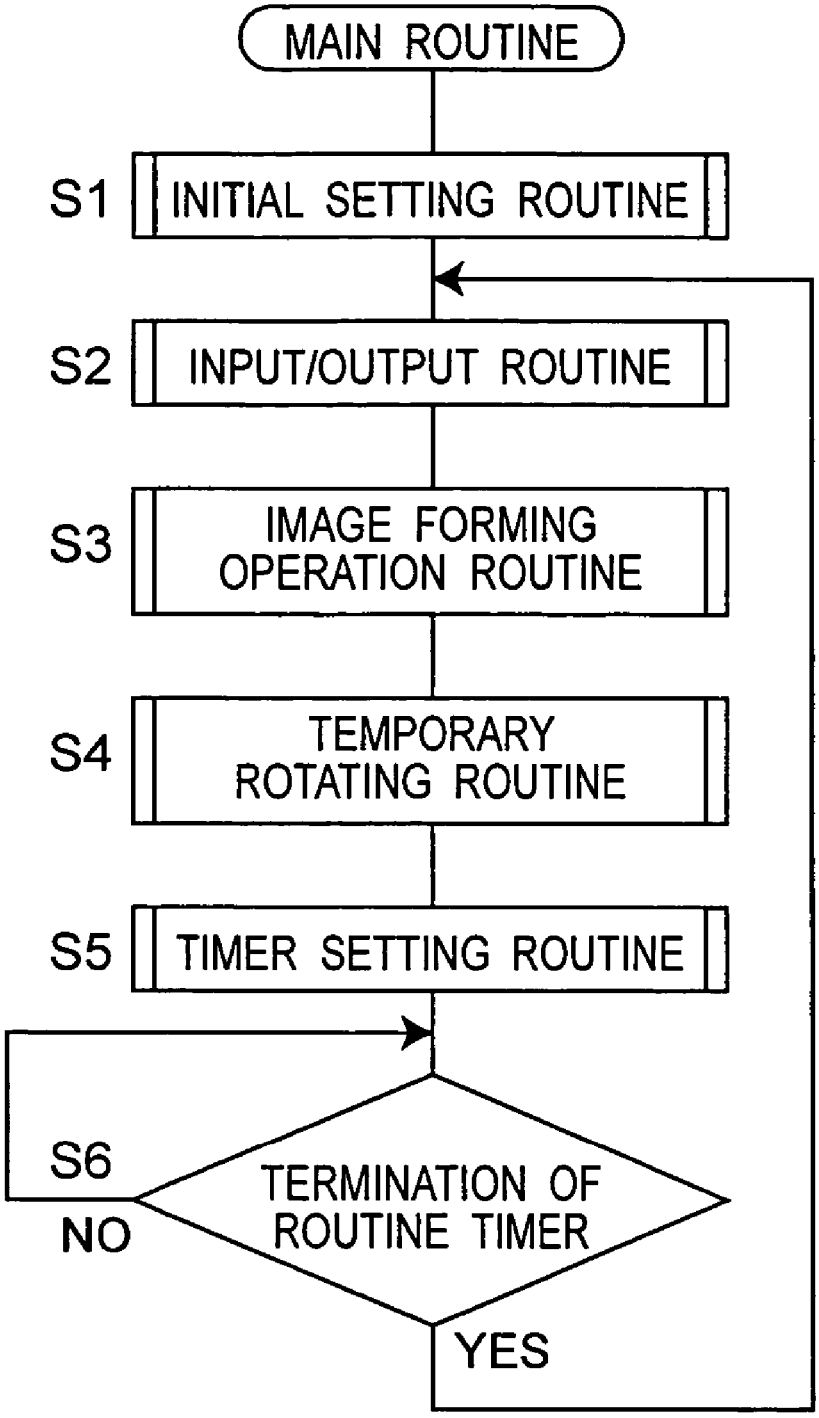
FIG. 5 is a flow chart showing a main routine executed in the control section; rotating routine constituting part of the main routine.

FIG. 5 shows a flow chart of a main routine executed in the control section 60. The control section 60 executes, first, an initial setting routine for initializing each data (step S1), then, an input/output routine for outputting a signal to each section in response to inputs from the outside, an operation panel and the like (step S2), an image forming operation routine for driving each section so that they perform image forming operations (step S3), an temporally rotating routine for temporarily operating the intermediate transfer belt 12 so as to rotate (step S4), a timer setting routine for setting an internal timer to a predefined value (step S5), and finally, a processing for going back to the step S2 upon termination of an routine timer (step S6).

Figure 6:
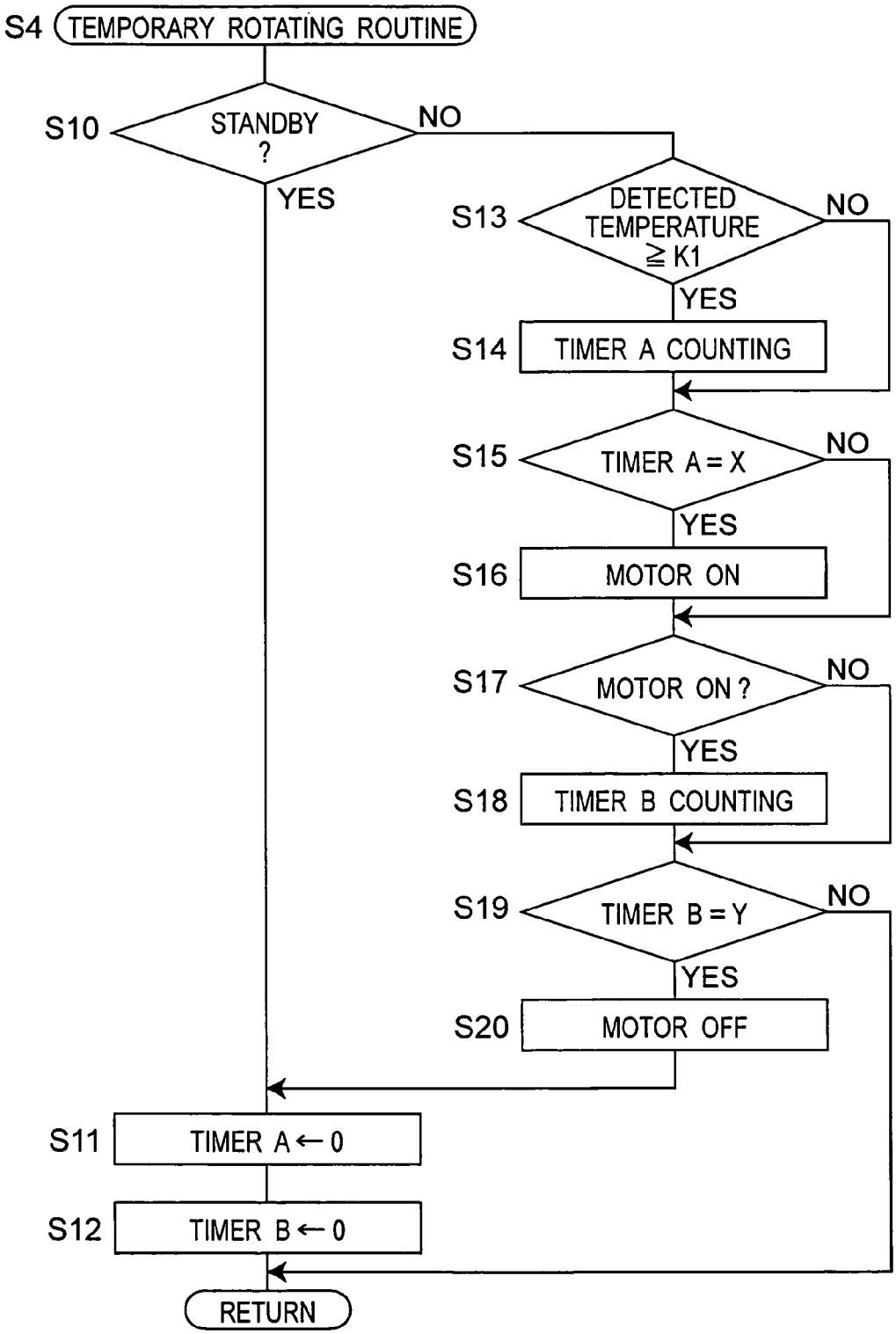
FIG. 6 is a flow chart showing a temporary rotating routine constituting part of the main routine.

Description will be now given of the temporary rotating routine in the step S4 with reference to a flow chart in FIG. 6.

In this processing, first, it is determined whether or not the apparatus is in an image forming state (i.e., image forming is operated) (step S10), and if in an image forming state, then a timer A and a timer B are each set to "0" (steps S11, S12). Here, the timer A defines time intervals at which the temporary rotating operation of the intermediate transfer belt 12 is carried out, while the timer B defines operating time of the temporary rotating operation of the intermediate transfer belt 12.

If it is determined that the apparatus is not in an image forming state (i.e., image forming is not operated) in the step S10, then it is determined whether or not a temperature detected by the intermediate transfer belt temperature sensor 62 is equal to or above a specified temperature K1 (45° C. in the present embodiment) (step S13). If the detected temperature is equal to or above the specified temperature K1, then counting with the timer A is started or continued (step S14), whereas if below the specified temperature K1, then the processing proceeds to step S15.

Next, it is determined whether or not a value of the timer A reached a predefined value X (step S15), and if the value reached the predefined value X, then the main motor 64 is turned on and the temporary rotating operation of the intermediate transfer belt 12 is started (step S16) If the value does not yet reach the predefined value X, then the processing proceeds to step S17. It is to be noted that the predefined value X is specifically set in the timer setting routine (step S5) described later.

Next, it is determined whether or not the main motor 64 is turned on (step S17), and if it is turned on, then counting with the timer B is started or continued (step S18), whereas if it is not turned on, then the processing proceeds to step S19.

Next, it is determined whether or not a value of the timer B reached a predefined value Y (step S19), and if it reached the predefined value Y, then the main motor 64 is turned off to stop the temporary rotating operation of the intermediate transfer belt 12 (step S20), and the timer A and the timer B are each reset to "0" (steps S11, S12). If the value does not yet reach the predefined timer value Y, then the processing returns to the main routine to execute the timer setting routine (step S5). It is to be noted that the predefined value Y is specifically set in the timer setting routine (step S5) described below.

As described above, by executing the temporary rotating routine in the step S4, the intermediate transfer belt 12 is temporarily rotated for a duration of the predetermined time Y immediately after the temperature thereof becomes equal to or above the specified temperature K1. Moreover, by repeatedly executing the temporary rotating routine (step S4) as part of the main routine shown in FIG. 5, the intermediate transfer belt 12 is temporarily rotated at the predefined intervals X as long as the temperature of the intermediate transfer belt 12 is kept not less than the specified temperature K1. Thus, the portions of the intermediate transfer belt 12 supported by the support rollers 14, 16, 18 are changed at predefined intervals, which allows restraint of the creep deformation of the intermediate transfer belt 12. As a result, it becomes possible to prevent generation of image noise attributed to the creep deformation of the intermediate transfer belt 12.

Figure 7:
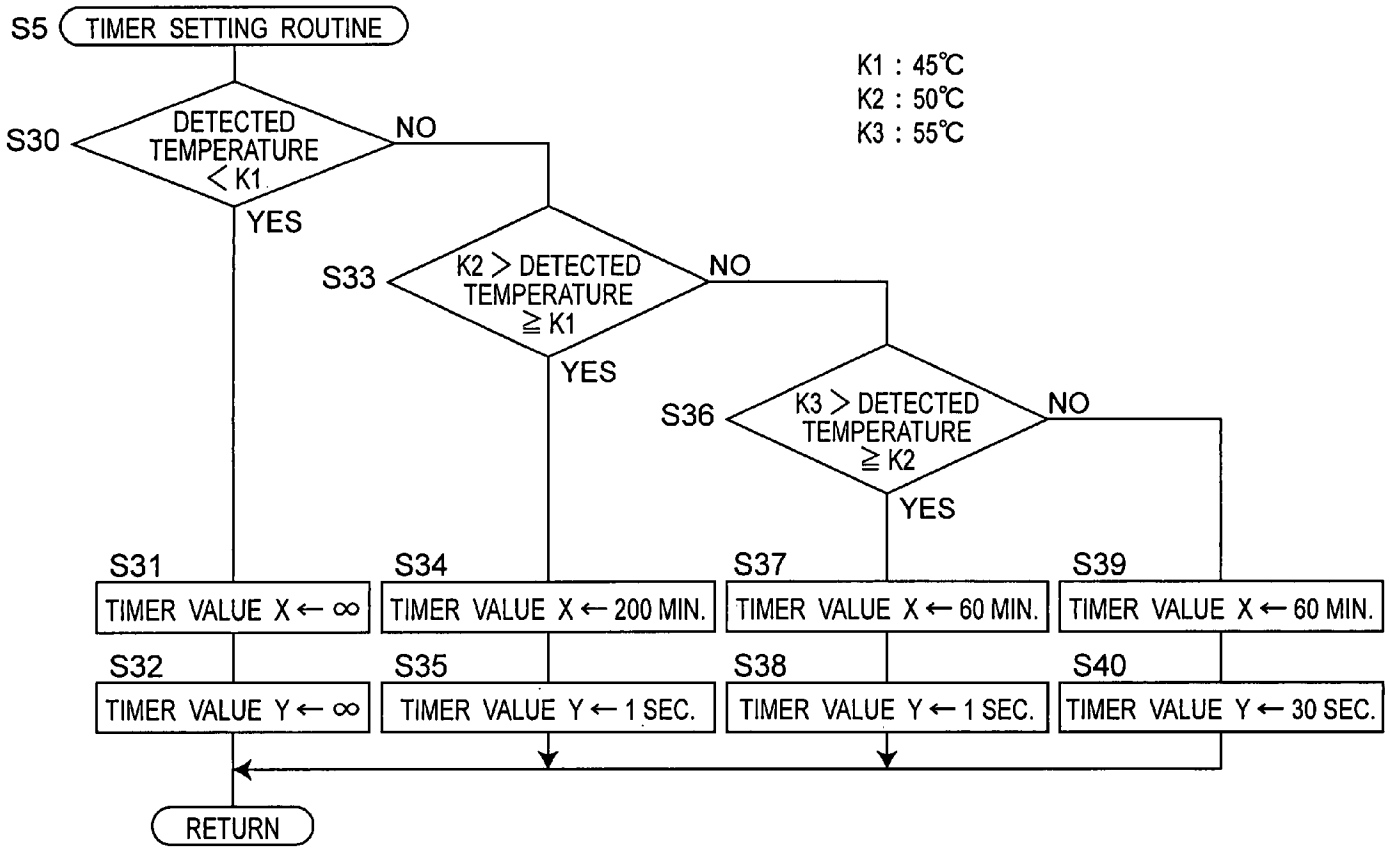
FIG. 7 is a flow chart showing a timer setting routine constituting part of the main routine.

Description will now be given of the timer setting routine in step S5 with reference to a flow chart in FIG. 7.

At first, it is determined whether or not a temperature detected by the intermediate transfer belt temperature sensor 62 is below a specified temperature K1 (45° C. in this embodiment) (step S30), and if the temperature is below the specified temperature K1, then a predefined value X of the timer A and a predefined value Y of the timer B are each set to infinite (steps S31, S32) If the temperature is equal to or above the specified temperature K1, then the processing proceeds to step S33.

In the step S33, it is determined whether or not a temperature detected by the intermediate transfer belt temperature sensor 62 is equal to or above a specified temperature K1 and is below a specified temperature K2 (50° C. in this embodiment), and if the temperature is equal to or above the specified temperature K1 and is below the specified temperature K2, then a predefined value X of the timer A is set to 200 minutes (step S34), and a predefined value Y of the timer B is set to 1 second (step S35). If the temperature is equal to or above the specified temperature K2, then the processing proceeds to the step S36.

In the step S36, it is determined whether or not a temperature detected by the intermediate transfer belt temperature sensor 62 is equal to or above a specified temperature K2 and below a specified temperature K3 (55° C. in this embodiment), and if the temperature is equal to or above the specified temperature K2 and is below the specified temperature K3, then a predefined value X of the timer A is set to 60 minutes (step S37), and a predefined value Y of the timer B is set to 1 second (step S38). If the temperature is equal to or above the specified temperature K3, then a predefined value X of the timer A is set to 60 minutes (step S39), and a predefined value Y of the timer B is set to 30 seconds (step S40).

The reason why the setting value of the timer A is 200 minutes when a temperature detected by the intermediate transfer belt temperature sensor 62 is equal to or above a specified temperature K1 and below a specified temperature K2, while the setting value of the timer A is as short as 60 minutes when the detected value is equal to or above a specified temperature K2 is to increase frequency of the temporal rotating operation in consideration to the fact that a higher temperature tends to cause more creep deformation of the intermediate transfer belt 12. Further, the setting value of 1 second of the timer B, which defines the operating time of the temporary rotating operation of the intermediate transfer belt 12, is the operating time enough for the potions of the intermediate transfer belt 12 winding about the support rollers 14, 16 for over 180 degrees to leave the support rollers 14, 16 and move to a straightly extended position. Furthermore, the reason why the setting value of the timer B is as long as 30 seconds when a temperature detected by the intermediate transfer belt temperature sensor 62 is equal to or above a specified temperature K3 is to straighten the portions of the intermediate transfer belt 12 supported by the rollers, which are configured in an arched shape during standby, by rotating the intermediate transfer belt 12 for a while.

Thus, in the timer setting routine in step S5, the predefined value X of the timer A that is time intervals in the temporary rotating operation of the intermediate transfer belt 12, and the predefined value Y of the timer B that is operating time of the temporary rotating operation of the intermediate transfer belt 12 are changed according to temperatures detected by the intermediate transfer belt temperature sensor 62.

It is to be noted that in the image forming apparatus 10 of the present embodiment, in an inoperative state when image forming is not operated, the temporary rotating operation of the intermediate transfer belt 12 is performed immediately after a temperature detected by the intermediate transfer belt temperature sensor 62 becomes equal to or above a specified temperature. However, the temporary rotating operation of the intermediate transfer belt 12 may be performed once a temperature detected by the intermediate transfer belt temperature sensor 62 becomes and stays equal to or above a specified temperature for not less than predefined consecutive time, or the temporary rotating operation of the intermediate transfer belt 12 may be performed once a duration of time during which a temperature detected by the intermediate transfer belt temperature sensor 62 becomes and stays equal to or above a specified temperature amounts to not less than predefined time.

Further in the image forming apparatus 10 of the present embodiment, the temperature of the intermediate transfer belt 12 is directly detected by the intermediate transfer belt temperature sensor 62. However, the temperature of the intermediate transfer belt 12 may be detected indirectly from the temperature measured by a temperature sensor (detection section) provided to measure an environmental temperature inside the apparatus or temperatures of other members, or the temperature of the intermediate transfer belt 12 may be detected (estimated) indirectly from an image printing mode such as a two-side printing mode (wherein the control section 60 functions as a detection section).

Furthermore in the image forming apparatus 10 of the present embodiment, the movable member having flexibility is an intermediate transfer belt 12. However, the present invention is also applicable if the movable member having flexibility, which is in the state of being curved under the action of an external force when image forming is not operated in an inoperative state, is a fixing belt 44, or electrically-charging members such as electrically-charging brushes or electrically-charging rollers, which are in press-contact with the surface of the photo conductor and allows rotative drive.

Furthermore, the present invention is also applicable to an image forming apparatus having a paper conveyer belt that has the same structure as the intermediate transfer belt 12 and rotates while holding paper on its surface as a movable member. In this type of image forming apparatuses, toner images of each color from each of the print units 24Y, 24M, 24C, 24K are respectively transferred onto a sheet of paper conveyed by the paper conveyer belt.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus for forming images on a recording medium, comprising:

a movable member having flexibility;

a detection section for detecting temperature of the movable member directly or indirectly; and a control section for executing control so that when image forming is not conducted, the movable member is temporarily operated at predefined intervals if a temperature detected by the detection section is equal to or above a specified temperature, and the movable member is not operated if a temperature detected by the detection section is below the specified temperature.

2. The image forming apparatus as defined in claim 1, wherein the predefined intervals are changed depending on the temperature detected by the detection section.

3. The image forming apparatus as defined in claim 1, wherein operating time of the movable member that is temporarily operated is changed depending on the temperature detected by the detection section.

4. The image forming apparatus as defined in claim 1, wherein the detection section detects the temperature of the movable member indirectly from an inside temperature of the apparatus.

5. The image forming apparatus as defined in claim 1, wherein the detection section detects the temperature of the movable member indirectly from an image printing mode.

6. The image forming apparatus as defined in claim 1, wherein the control section temporarily operates the movable member immediately after the temperature detected by the detection section becomes equal to or above a specified temperature.

7. The image forming apparatus as defined in claim 1, wherein the control section temporarily operates the movable member once the temperature detected by the detection section becomes and stays equal to or above a specified temperature for not less than predefined consecutive time.

8. The image forming apparatus as defined in claim 1, wherein the control section temporarily operates the movable member once a duration of time during which the temperature detected by the detection section becomes and stays equal to or above a specified temperature amounts to not less than predefined time.

9. The image forming apparatus as defined in claim 1, wherein the movable member is an endless belt hung over at least two rollers.

10. The image forming apparatus as defined in claim 9, wherein the endless belt is an intermediate transfer belt.

11. The image forming apparatus as defined in claim 9, wherein the endless belt is a fixing belt.

12. The image forming apparatus as defined in claim 1, wherein the movable member is an electrically-charging member.

13. A method for controlling an image forming apparatus including a movable member having flexibility, comprising:

a step 1 for detecting a temperature of the movable member directly or indirectly when the image forming apparatus is not under image forming operation; and a step 2 for executing control so that the movable member is temporarily operated at predefined intervals if the temperature detected in the step 1 is equal to or above a specified temperature, and the movable member is not operated if the detected temperature is below the specified temperature.

14. The method as defined in claim 13, wherein the predefined intervals in the step 2 are changed depending on the temperature detected in the step 1.

15. The method as defined in claim 13, wherein operating time of the movable member that is temporarily operated in the step 2 is changed depending on the temperature detected in the step 1.

16. The method as defined in claim 13, wherein in the step 2, the movable member is temporarily operated immediately after the temperature detected in the step 1 becomes equal to or above a specified temperature.

17. The method as defined in claim 13, wherein in the step 2, the movable member is temporarily operated once the temperature detected in the step 1 becomes and stays equal to or above the specified temperature for not less than predefined consecutive time.

18. The method as defined in claim 13, wherein in the step 2, the movable member is temporarily operated once a duration of time during which the temperature detected in the step 1 becomes and stays equal to or above a specified temperature amounts to not less than specified time.

19. The method as defined in claim 13, wherein the movable member is an endless belt hung over at least two rollers.

20. The method as defined in claim 19, wherein the endless belt is an intermediate transfer belt.

* * * * *